US011540603B2

(12) United States Patent
Yasuda et al.

(10) Patent No.: US 11,540,603 B2
(45) Date of Patent: Jan. 3, 2023

(54) CONTACT LENS CASE

(71) Applicant: MENICON CO., LTD, Aichi (JP)

(72) Inventors: Akihiro Yasuda, Aichi (JP); Stephen D. Newman, Bayshore Park (SG)

(73) Assignee: MENICON CO., LTD.

( * ) Notice: Subject to any disclaimer, the term of this patent is extended or adjusted under 35 U.S.C. 154(b) by 0 days.

(21) Appl. No.: 17/052,171

(22) PCT Filed: May 1, 2018

(86) PCT No.: PCT/JP2018/017458
§ 371 (c)(1),
(2) Date: Oct. 30, 2020

(87) PCT Pub. No.: WO2019/211902
PCT Pub. Date: Nov. 7, 2019

(65) Prior Publication Data
US 2021/0052054 A1 Feb. 25, 2021

(51) Int. Cl.
*A45C 11/00* (2006.01)

(52) U.S. Cl.
CPC ..... *A45C 11/005* (2013.01)

(58) Field of Classification Search
CPC ..... A45C 11/005
USPC ..... 206/5.1
See application file for complete search history.

(56) References Cited

U.S. PATENT DOCUMENTS 4,392,569 A 7/1983 Shoup
4,942,959 A 7/1990 Sauber et al.
5,467,868 A * 11/1995 Abrams ..... A61F 2/1691 206/5.1
5,711,416 A * 1/1998 Bauman ..... A45C 11/005 206/210
7,225,919 B2 * 6/2007 Hamilton ..... B65D 75/326 134/901
2012/0042533 A1 2/2012 Evans

FOREIGN PATENT DOCUMENTS

JP S52-055749 U 4/1977
JP S54-123232 U 8/1979
JP 2002006274 A 1/2002
JP 2014157171 A 8/2014
JP 2014157172 A 8/2014
WO 2008120954 A1 10/2008
WO 2013140452 A1 9/2013

OTHER PUBLICATIONS

International Search Report and Written Opinion of the International Searching Authority for International Patent Application No. PCT/JP2018/017458, dated Jul. 10, 2018 (10 pages).
European Search Report dated Oct. 21, 2021 received in EP App. No. 18917475.8.

* cited by examiner

*Primary Examiner* — Steven A. Reynolds
(74) *Attorney, Agent, or Firm* — Dorsey & Whitney LLP

(57) ABSTRACT

A contact lens case includes a platform portion. The platform portion can include a receiving body, an inner wall formed in the receiving body, a floor connected to the inner wall, the inner wall and the floor defining a chamber, and a lens positioning guide formed in the floor of the chamber.

19 Claims, 8 Drawing Sheets

CONTACT LENS CASE

CROSS-REFERENCE TO RELATED APPLICATIONS

This application is a U.S. national stage filing under 35 U.S.C. § 371 of PCT International Application No. PCT/JP2018/017458 filed on 1 May 2018.

BACKGROUND

Contact lenses are provided to users in various modalities. While some contact lenses are identified as daily disposable lenses, intended to be discarded every day after use, some contact lens are constructed to be worn by a user for multiple days. To preserve these contact lenses at night or during other times that they are not being worn by a user, the contact lens is often immersed in a storage solution. The storage solution can contain saline that includes a contaminant neutralizing or sterilizing component. The contaminants can have come from the user's own eye when the contact lenses were being worn by the user. In some cases, the contaminants can have come from a user's hands when the user was handling the contact lenses. Other sources of contaminants can include the user's environment when wearing the contact lenses on his or her eyes. The storage solution can also keep the contact lenses hydrated until the user is ready to wear the contact lenses again. The storage solution can be contained within a contact lens case.

One example of contact lens case is disclosed in Japanese Published Patent Application No. 2002-6274 (JP2002-6274A). In this reference, a structure contains a conservation liquid, a package body provided with a concave portion in which a contact lens is stored, and a lid with which an upper opening of the concave portion is equipped that can cover the upper opening. The contact lens is immersed into conservation liquid and the lid can be secured to the package body to seal preservation liquid and the contact lens within the concave portion. This publication is incorporated by reference for all that it contains.

SUMMARY

In some embodiments, a contact lens case includes a cap portion and a platform portion. The cap portion includes a cap body, a protrusion extending from the cap body, a distal end of the protrusion, and a curved surface formed on the distal end of the protrusion. The platform portion includes a receiving body, an inner wall formed in the receiving body, a floor connected to the inner wall, the inner wall and the floor defining a chamber, and a lens positioning guide formed in the floor of the chamber.

The lens positioning guide can be a recess.

The lens positioning guide can be a riser that includes a top surface. The top surface can be spaced a distance away from a level of the floor.

The lens positioning guide can be a slope formed in the floor.

The lens positioning guide can be positioned to center a contact lens within the receiving body.

The contact lens case can include a circumferential lip formed on the curved surface of the protrusion of the cap body. The lens positioning guide can be positioned to guide an edge of a contact lens against the lip.

The lens positioning guide can be configured to contact a peripheral portion of the contact lens.

The lens positioning guide can include a guide curvature where the guide curvature substantially follows an anterior side curvature of the contact lens.

The lens positioning guide can be configured to contact within a peripheral portion defined by a midpoint of a radius of an anterior side of the contact lens and an edge of the contact lens.

The curved surface of the protrusion can be configured to adhere to a posterior side of a contact lens when the contact lens is wetted.

The contact lens case can include a first thread portion connected to the platform portion, and a second thread portion connected to the cap portion. The first thread portion and second thread portion can be configured to be threadedly connected to one another to close off the chamber.

The distal end of the protrusion can extend farther from the cap body than an end of the second threaded portion.

The distal end of the protrusion and the floor of the chamber can be separated by less than 10 millimeters when the first thread portion and second thread portion are threadedly connected to one another.

In some embodiments, a contact lens case includes a platform portion. The platform portion can include a receiving body, an inner wall formed in the receiving body, a floor connected to the inner wall, the inner wall and the floor defining a chamber, and a lens positioning guide formed in the floor of the chamber.

In some embodiments, a contact lens case includes an inner wall formed in the receiving body, a floor connected to the inner wall, the inner wall and the floor defining a chamber, and a recess defined in the floor. The recess can be configured to hold a contact lens adjacent to a protrusion of a cap portion.

In some embodiments, a contact lens case includes a cap portion, a protrusion extending from the cap portion, an inner wall surrounding the protrusion, and a chamber being defined by the inner wall. A lens positioning guide can be disposed within the chamber, and the lens positioning guide can be configured to hold a contact lens adjacent to the protrusion.

The contact lens case can include a floor, and the lens positioning guide can be a recess defined in the floor.

The contact lens case can include a floor, and the lens positioning guide can be a riser incorporated into the floor.

The lens positioning guide can be configured to engage the contact lens in a peripheral portion of the contact lens.

The lens positioning guide can be configured to engage the contact lens on any portion of the peripheral portion, including the perimeter or middle of the peripheral portion of the contact lens.

The lens positioning guide can include a peripheral region, and the peripheral region can be configured to make contact with the contact lens.

The lens positioning guide can include a mid-peripheral region, and the mid-peripheral region can be configured to make contact with the contact lens.

The accompanying drawings illustrate various embodiments of the present apparatus and are a part of the specification. The illustrated embodiments are merely examples of the present apparatus and do not limit the scope thereof.

BRIEF DESCRIPTION OF DRAWINGS

Throughout the drawings, identical reference numbers designate similar, but not necessarily identical, elements.

DETAILED DESCRIPTION

Figure 1:
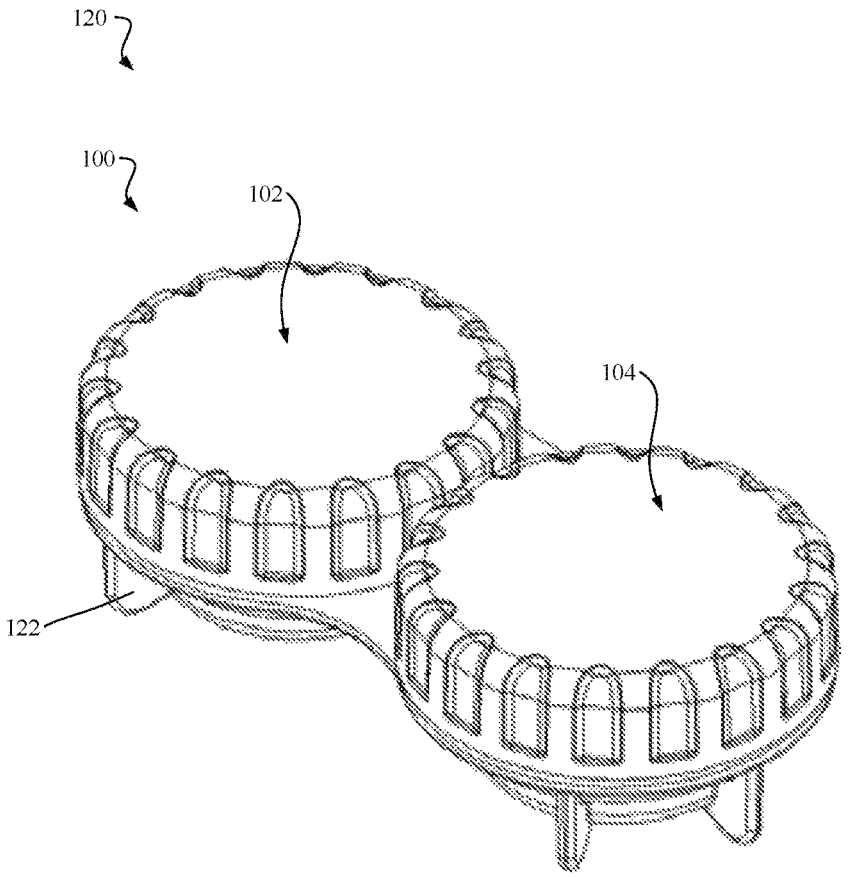
FIG. 1 illustrates a perspective view of an example of a contact lens case in accordance with the present disclosure.

The principles described in the current disclosure relate to contact lens cases. The exemplary contact lens case includes a cavity that holds storage solution, in which a contact lens can be immersed when not being worn by the user. Generally, when a contact lens is removed from a contact lens case, the user's finger is inserted into the cavity of a contact lens case that contains the contact lens and the storage solution. Typically, a user slides a finger along the bottom surface of the case's cavity, pressing down on the back or inner surface of the contact lens, which follows the profile of the user's finger.

The contact lens is then typically slid up the side of the lens case by the finger, dragging the front surface of the lens along the bottom of the lens case, and continuing contact of the back or inner surface of the lens with the user's finger. Once disposed at the opening of the contact lens case, the user can grasp the contact lens with the user's thumb on the outer side of the contact lens and the finger on the back or inner surface of the contact lens to remove the contact lens from the cavity of the contact lens case. The user then typically re-orients the lens on his or her finger and brings the contact lens to his or her eye for insertion. The posterior/concave side of the contact lens, which was engaged with the user's finger, is placed against the user's eye. The tear fluid wets the posterior side of the contact lens keeping the contact lens in place.

Various issues arise with this conventional process of removing a contact lens from the contact lens case. Specifically, the user's finger and/or thumb come into contact with the posterior side of the contact lens, which then comes into direct contact with the user's eye. As a result, germs, dirt, pollutants, and other undesirables from the user's finger can be transferred to the user's eye. These contaminants can cause inflammation of the eye, as well as provide an entry point for disease to enter the user's body.

Other issues with the conventional manner of removing the contact lens from the traditional contact lens case result from inserting a finger into a narrow cavity and sliding the contact lens across surfaces of the cavity. This process can scratch or otherwise damage the inner surface and outer periphery portions of the contact lens. Furthermore, by placing the finger into the cavity of the case where the storage solution resides can expose the storage solution to the user's finger. Thus, the germs, dirt, and pollutants of the user's finger can also contaminate the storage solution.

The principles contained in the present disclosure include a system and method for providing a contact lens case that includes a cap portion and a platform portion. The cap portion includes a protrusion that is connected to a cap body. The protrusion includes a distal end that has a curved surface. The platform portion includes a chamber that is defined by an inner wall and floor. The chamber can contain storage solution and a contact lens. The protrusion can be sufficiently long to be submerged into the storage solution when the cap portion is secured to the platform portion. With the distal end submerged into the storage solution, the distal end can be wetted with the storage solution. The posterior side of the contact lens can adhere to the curvature of the distal end when the distal end is wetted.

The user can remove the cap portion of the contact lens case from the platform portion, thereby removing the distal end of the protrusion from the chamber and thus removing the distal end from being submerged in the storage solution in those cases where the chamber contains a sufficient amount of storage solution so that the distal end is submerged. With the distal end wetted, the user can place the contact lens on the curvature of the distal end so that the contact lens' posterior side is in direct contact with the distal end. In some cases, the curvature of the distal end complements or substantially complements the curvature of the contact lens' posterior side. With the contact lens adhering to the distal end of the protrusion, the contact lens can move with the distal end. For example, the contact lens can adhere to and move with the distal end as the cap portion is secured to the platform portion. Thus, in those examples where the chamber includes a sufficient amount of storage solution for the distal end to be submerged, the contact lens is also submerged into the storage solution.

The floor of the chamber can include a lens positioning guide, which prevents the contact lens from dissociating from the protrusion when the contact lens is fully submerged into the storage solution. In some examples, a gap between the distal end of the protrusion and the floor chamber is ten millimeters or less, five millimeters or less, 1 millimeter or less, another distance, or combinations thereof. Even with a small gap in place between the protrusion's distal end and the chamber's floor, the contact lens can be prone to dissociating from the distal end due to lateral forces imposed by moving the contact lens case. Other forces that can contribute to the dissociating the contact lens from the distal end of the protrusion include gravity or dynamic fluid forces when the contact lens case's orientation changes due to being carried or otherwise being moved.

The lens positioning guide can engage the contact lens at a region other than the center of the contact lens to prevent the contact lens from moving laterally off of the curvature of the distal end. For example, the lens positioning guide can engage the contact lens at a periphery of the contact lens. In other examples, the contact lens includes a peripheral portion that is defined by an edge of the contact lens and a midpoint of the contact lens' radius. In this example, the lens positioning guide can engage the contact lens within this peripheral portion. In some cases, the lens positioning guide includes an annular surface that blocks the contact lens from moving in any direction. In other examples, the lens positioning guide includes isolated contact points that collectively prevent the contact lens from moving laterally off of the curvature of the distal end. In some cases, the lens positioning guide pushes a portion of the contact lens into the distal end of the protrusion. For example, in some cases, the distal end of the protrusion includes a circumferential lip that protrudes out and away from an edge of the distal end's curvature, and the lens positioning guide pushes an edge of the contact lens against the circumferential lip to substantially maintain the position of the contact lens on the distal end.

When the cap portion of the contact lens case is removed from the platform portion, the contact lens remains adhered to the distal end of the protrusion. Thus, the contact lens is removed from the contact lens case as the cap portion is removed from the contact lens case. This arrangement provides several advantages. First, the geometries of the upper portion and the platform portion prevent the contact lens from unwanted movement as the contact lens is removed from the case's chamber. As a result, the various surfaces of the contact lens is not subjected to the same sliding engagement with the surfaces of the chamber that conventional systems allow. Accordingly, the contact lens is less prone to being scratched as it is removed from the chamber.

Second, with the posterior side of the contact lens adhered to the surfaces of the protrusion, the anterior surface of the lens is presented to the user when the user grasps the contact lens off of the protrusion. That is, only the anterior side of the contact lens is available for contact with the user's fingers. As a result, the user can remove the contact lens from the protrusion by contacting just the anterior side of the contact lens, which allows the posterior side of the contact lens to be untouched by the user when it is removed from the protrusion to the user's eye. Consequently, germs, debris, pollutants, and other types of contaminants or undesirables from the user's hand can be isolated to the anterior side of the contact lens, which does not come into direct contact with the eye. The anterior side of the contact lens can come into contact with the user's eyelid, which is biometrically designed to clean and protect the eye. Thus, the germs, debris, pollutants, and other types of undesirables are subjected to those cleaning forces naturally imparted by the eyelid. As a result, the user is less prone to adverse effects resulting from contact lens contaminants.

Several factors can affect how adequately the contact lens adheres to the distal end of the protrusion. These factors can include the viscosity of the storage solution, the surface tension of the storage solution, the volume of storage solution within the chamber, the curvature of the protrusion's distal end, the surface roughness of the protrusion's distal end, other factors, or combinations thereof.

In some cases, the curvature of the protrusion's distal end complements the curvature of the posterior side of the contact lens. In other cases, the protrusion's distal end can include a larger radius of curvature than that of the contact lens. In both of these types of embodiments, the surface tension of the storage solution can cause the contact lens to adhere to the distal end's surface. In some cases, the distal end's radius of curvature is between 10 millimeters and 15 millimeters. In yet another example, the distal end's radius of curvature is between 12 millimeters and 13 millimeters. The curvature of the distal end can be a consistent radius of curvature such that the curvature forms part of a spherical shape. In other examples, the distal end's radius of curvature changes across the surface of the curvature. For example, the radius of curvature can be flatter towards the periphery of the curvature or flatter towards the center of the curvature.

In some cases, the distal end's radius of curvature can be larger than the radius of curvature of the contact lens. In one of these examples, the contact lens' posterior side can include a radius of curvature that is approximately 8.1 to 9.0 millimeters. In other examples, the posterior side of the contact lens can include a radius of curvature that is 7.5 millimeters or less.

Any appropriate surface roughness can be incorporated into the distal end of the protrusion. In some examples, the surface roughness average (Ra) is 25.0 micrometers or less. In another example, the surface roughness average is 6.3 micrometers or less.

Figure 2:
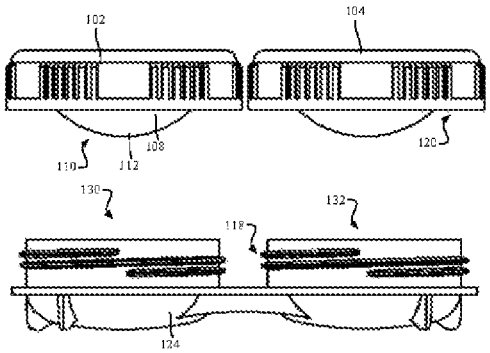
FIG. 2 illustrates a side view of an example of a contact lens case in accordance with the present disclosure.
Figure 3A:
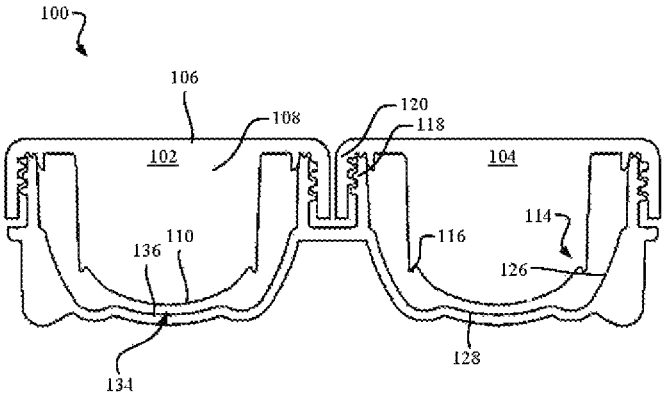
FIG. 3A illustrates a side cross-sectional view of an example of a contact lens case in accordance with the present disclosure.

Now referring to the figures, FIGS. 1-3A depict an example of a contact lens case 100. In this example, the contact lens case 100 can include a cap portion 102 and a platform portion 122. FIG. 1 depicts a perspective view of the contact lens case 100 with the cap portion 102 secured to the platform portion 122. FIG. 2 depicts a side view of the contact lens case 100 with the cap portion 102 removed from the platform portion 122. FIG. 3A depicts a cross-sectional side view of the contact lens case 100 with the cap portion 102 secured to the platform portion 122.

The platform portion 122 can include a receiving body 124 that has a substantially flat surface that provides stability to the contact lens case 100 when resting on a support surface, such as a counter top or sink surface. In other examples, the platform portion 122 includes a plurality of legs that stabilize the platform portion 122 in an upright orientation. In the upright position, the contact lens case 100 is oriented such that the storage solution pools in the bottom of the chamber 130 and away from the threaded portions or other connection mechanisms that secure the cap portion 102 to the platform portion 122. The platform portion 122 can also include an inner wall 126 that is connected to a floor 128. The inner wall 126 and the floor 128 collectively define the chamber 130. The chamber 130 can be configured to receive a volume of contact lens storage solution. A contact lens can be inserted into the chamber 130 and be submerged in the storage solution for a desired period of time, such as overnight, until the user decides to reinsert the contact lens back into the user's eye.

Any appropriate type of storage solution can be used in connection with the principles disclosed herein. In some examples, the storage solution includes a disinfectant that kills bacteria, viruses, fungus, germs, enzymes, contaminants, un-desirable organisms, or combinations thereof that are on the contact lens. In some examples, the storage solution also prevents a protein build-up, a lipid build-up, a debris build-up, or other type of build-up on the contact lens. Further, the storage solution can include ingredients that improve wettability and comfort of silicon hydrogel contact lenses. In some cases, the storage solution includes a saline solution, a hydrogen peroxide solution, another type of solution, or combinations thereof.

In some examples, the platform portion 122 includes a first chamber 130 and a second chamber 132. In this example, the contact lens case 100 includes a first cap portion 102 and a second cap portion 104. The first chamber 130 can correspond to the right contact lens, and the second chamber 132 can correspond to the left contact lens. This allows both contact lenses to be received and stored separately. While the examples of the contact lens cases 100 of FIGS. 1-3A are depicted with multiple chambers, any appropriate number of chambers can be incorporated into the contact lens case 100 and can include the principles of the present exemplary system and method. In some examples, the contact lens case 100 includes just a single chamber 130.

The contact lens case 100 can be formed through any appropriate manufacturing methodologies. In some cases, the contact lens case 100 is injection molded using synthetic resins, such as polypropylene (PP), polyethylene (PE), polystyrene (PS), polycarbonate (PC), polyethylene terephthalate (PET), acrylonitrile butadiene styrene copolymer (ABS), propylene ethylenic copolymer, or combinations thereof. In other examples, the contact lens case 100 can be casted, machined, or otherwise formed. In some cases, the cap portion 102 is made of the same materials as the platform portion 122. Alternatively, the cap portion 102 can be formed of a disparate material when compared to the platform portion 122.

In some cases, the platform portion 122 includes a first thread portion 118, and the cap portion 102 includes a second thread portion 120. In some cases, the first thread portion 118 is an outer thread portion, and the second thread portion 120 is an inner thread portion. However, in other examples, the first thread portion 118 can be an inner thread portion, and the second thread portion 120 can be an outer thread portion. The first thread portion 118 and the second thread portion 120 can be threadedly connected to one another. With the cap portion 102 secured to the platform portion 122 through the threaded portions, the cap portion 102 closes off the chamber 130.

While these examples have been described with reference to the contact lens case 100 having the cap portion 102 and the platform portion 122 connected through complimentary threaded portions, the cap portion 102 and the platform portion 122 can be connected through any appropriate mechanism. For example, the cap portion 102 and the platform portion 122 can be secured together through a snap connection, a compression fit connection, an interference fit connection, a hinged connection, another type of connection, or combinations thereof. In some examples, the connection is water tight to prevent the storage solution from leaking out of the chamber 130 when the contact lens case 100 is oriented on its side or upside-down.

A protrusion 108 can be connected to the cap body 106. The protrusion 108 can extend farther away from the cap body 106 than the second threaded portion. The protrusion 108 can include a distal end 110, and the distal end 110 can include a curved surface 112. The contact lens can adhere to the curved surface 112 of the distal end 110 when placed on the curved surface 112 and when the contact lens and distal end are wetted. In the example of FIG. 3, the protrusion 108 includes a circumferential lip 114 that surrounds an edge of the curved surface 112. This circumferential lip 114 forms a lip wall 116 that can contribute to preventing the contact lens from sliding off of the curved surface 112 of the protrusion 108.

A lens positioning guide 134 is formed in the floor 128 of the platform portion 122 of the contact lens case 100. The lens positioning guide 134 can include a contact point configured to contact a non-center portion of the contact lens to assist in keeping the contact lens on the curved surface 112 of the protrusion 108. In this example, the lens positioning guide 134 includes a guide curvature 136 that is configured to make contact with a peripheral portion of the contact lens. In some cases, the guide curvature is a portion of the slope of the floor 128 of the chamber 130. The lens positioning guide 134 can hold the contact lens against the curved surface 112 in situations where fluid forces can otherwise cause the contact lens to be dislodged from the curved surface 112.

In some cases, a center portion of the contact lens comes into contact with a central portion of the floor 128 of the chamber 130. In those examples where the distance between the floor 128 and the distal end 110 or circumferential lip 114 of the protrusion 108 are less than the sagittal depth of the contact lens, the protrusion 108 and the floor 128 can collectively impose a compressive load or deforming load on the contact lens that assists in keeping the contact lens up against the curved surface 112. However, due to the curvature of the distal end 110, the gap between the floor 128 and the distal end 110 can progressively increase from the central portion of the floor 128 towards the edge of the curved surface 112. In such circumstances, the contact lens can otherwise be prone to dislodging from the curved surface 112 if the contact lens were positioned off center on the curved surface 112. In the example of FIG. 3, the lens positioning guide 134 keeps the gap narrow along the distal end's entire curvature allowing the contact lens to be held in compression in situations where the central gap is sufficiently narrow. Also, the lens positioning guide 134 of FIG. 3A can engage the contact lens on a central location of the contact lens to assist with keeping the contact lens against the distal end 110.

Figure 3B:
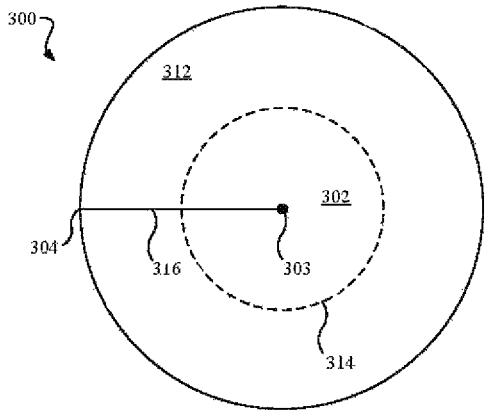
FIG. 3B illustrates a top view of an example of a contact lens in accordance with the present disclosure.

FIG. 3B depicts an example of a contact lens 300. In this example, the contact lens 300 includes a central portion 302 and a peripheral portion 312. In some examples, the contact lens 300 makes contact with the lens positioning guide 134 within the peripheral portion 312. But, the lens positioning guide 134 can make contact with the contact lens 300 at any appropriate location including within the central portion 302. In some examples, the peripheral portion 312 of the contact lens 300 can be defined by a midpoint 314 between the center 303 of the contact lens 300 and an edge 304 of the contact lens 300. In the example of FIG. 3B, the midpoint of the contact's lens' radius 316 is schematically represented with the dashed circle 314.

Figure 4:
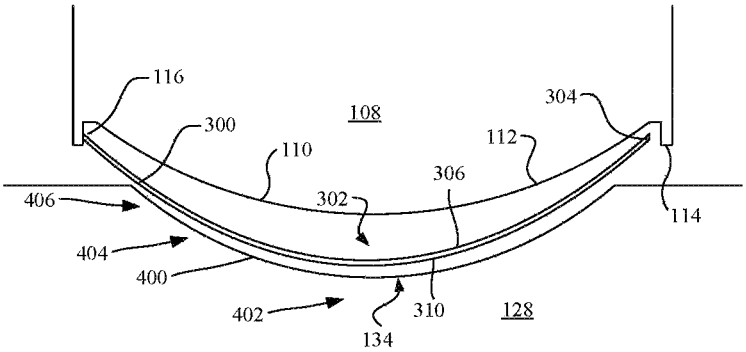
FIG. 4 illustrates a cross-sectional view of an example of a lens positioning guide in accordance with the present disclosure.

FIG. 4 depicts an example of a lens positioning guide 134 in accordance with the principles described in the present disclosure. In this example, a contact lens 300 is disposed between the distal end 110 of the protrusion 108 and the floor 128 of the case's chamber 130. In the illustrated example, the lens positioning guide 134 is incorporated into the floor 128 of the case's chamber 130.

In the illustrated example, the protrusion 108 includes a circumferential lip 114 encircling the curved surface 112 of the distal end 110. The circumferential lip 114 forms a lip wall 116 that also encircles the distal end's curved surface 112. The curved surface 112 of the distal end 110 can include a radius of curvature that is between 10 millimeters and 15 millimeters.

The lens positioning guide 134 is a recess 400 that is defined in the floor 128 of the chamber 130. The recess 400 can include a concave curvature that makes contact with the contact lens 300. In some cases, the contact lens 300 makes contact with the recess 400 just in those circumstances where the contact lens 300 is off-center with respect to the center of the protrusion 108. In other examples, the lens positioning guide 134 makes contact with the peripheral portion 312 of the contact lens 300 regardless of whether the contact lens 300 is off-center or not. The concave curvature of the lens positioning guide 134 can include a central region 402, a mid-peripheral region 404, and a peripheral region 406.

The contact lens 300 can include a posterior side 306 that has a concave curvature. The posterior side 306 can be placed on the cornea of the user's eye when worn by the user. The contact lens 300 can also include an anterior side 310 that has a convex curvature. The anterior side 310 can be separated from the posterior side 306 by a thickness of the contact lens 300 material. The posterior side 306 and the anterior side 310 are joined at an edge 304 of the contact lens 300.

The lens positioning guide 134 can be shaped to make contact with the contact lens 300 in the central region 402, the mid-peripheral region 404, the peripheral region 406, or combinations thereof, of the concave recess 400. The contact lens 300 can be directed up against the lip wall 116 of the protrusion 108. By catching the edge 304 of the contact lens 300 with the lip wall 116, the contact lens 300 can be prevented from sliding off of the concave curved surface 112 of the protrusion's distal end 110.

In other examples, the protrusion 108 does not include a lip wall 116, and the lens positioning guide 134 keeps the contact lens 300 centered within the chamber 130 by contacting a peripheral region or mid-peripheral region of the contact lens 300. In this example, the lens positioning guide 134 can keep the contact lens 300 adjacent to the distal end 110 of the protrusion 108 so that when the cap portion 102 is removed from the platform portion 122, the contact lens 300 remains adhered to the distal end 110 and is removed with the cap portion 102.

Figure 5:
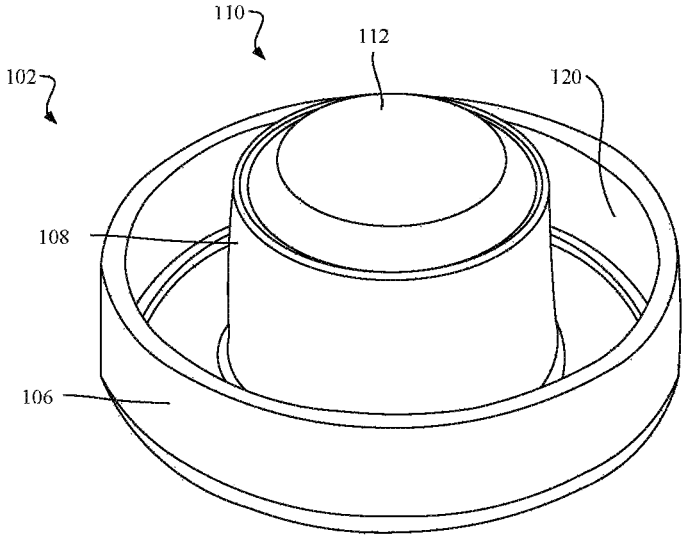
FIG. 5 illustrates a perspective view of an example of a top view of a contact lens case in accordance with the present disclosure.
Figure 6:
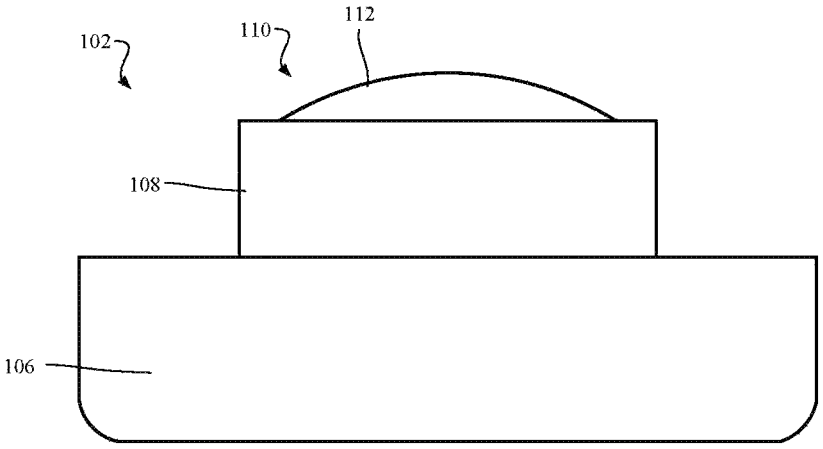
FIG. 6 illustrates a side view of an example contact lens case in accordance with the present disclosure.

FIGS. 5 and 6 depict an example of a cap portion 102. In this example, the cap portion 102 includes a cap body 106 and an attachment portion. In some cases, the attachment portion includes an inner thread portion 120 that is configured to be threadedly secured to an outer threaded region of the platform portion 122. The cap portion 102 can also include a protrusion 108 that extends from the cap body 106. The attachment portion can encircle the protrusion 108, and the protrusion 108 can extend beyond the attachment portion. In some cases, the threaded region of the platform portion 122 can be disposed between the protrusion 108 and the attachment region of the cap portion 102 when the cap portion is connected to the platform portion 122.

Figure 7:
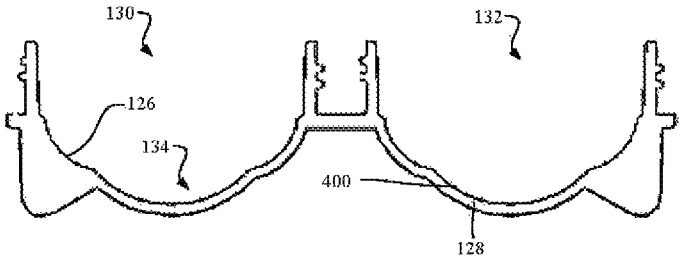
FIG. 7 illustrates a cross-sectional view of an example lens positioning guide in accordance with the present disclosure.

FIG. 7 depicts a side cross-sectional view of an example of a platform portion 122. In this example, the platform portion 122 includes a first chamber 130 and a second chamber 132. A first leg is connected to the first chamber 130, and a second leg is connected to the second chamber 132. Additional legs can be secured to the platform portion 122 that are not visible in this particular cross section. In this example, the floor 128 of the chamber 130 includes a rounded curve connecting the inner wall 126 to the floor 128. A recess 400 is formed in the floor 128 that forms, at least in part, the lens positioning guide 134. A peripheral region 406 (illustrated in FIG. 4) of the lens positioning guide 134 can make contact with a contact lens to position the contact lens against the distal end 110 of the protrusion 108 when the cap portion 102 is secured to the platform portion 122.

Figure 8:
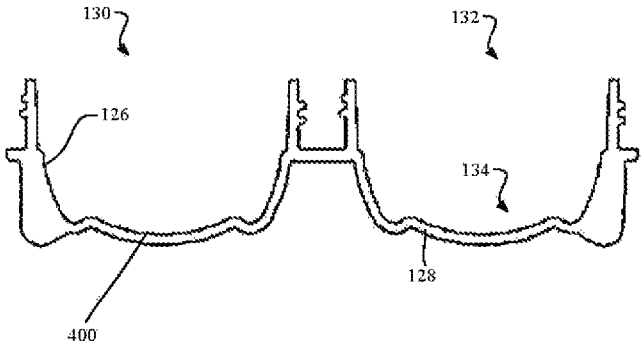
FIG. 8 illustrates a cross-sectional view of an example lens positioning guide in accordance with the present disclosure.

FIG. 8 depicts an example of a platform portion 122. In this example, the floor 128 of the chamber 130 includes a wider recess that forms, at least in part, the lens positioning guide 134. In this example, the peripheral region 406 (illustrated in FIG. 4) and/or the mid-peripheral region 404 (illustrated in FIG. 4) can make contact with the contact lens.

Figure 9:
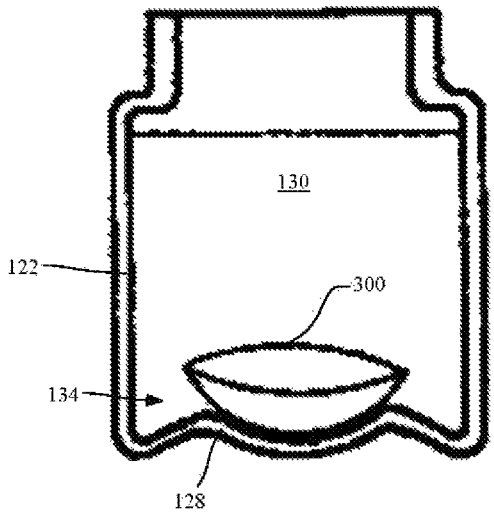
FIG. 9 illustrates a cross-sectional view of an example lens positioning guide in accordance with the present disclosure.

FIG. 9 depicts an example of a platform portion 122 that includes just a single chamber 130. In this example, a contact lens 300 is disposed within the chamber 130 and is in contact with the lens positioning guide 134. In this example, the lens positioning guide 134 contacts a central and mid-peripheral region of the contact lens. The lens positioning guide 134 can keep the contact lens centered within the region. In this example, the floor 128 is shaped to form the legs of the platform portion 122 and the lens positioning guide 134.

Figure 10:
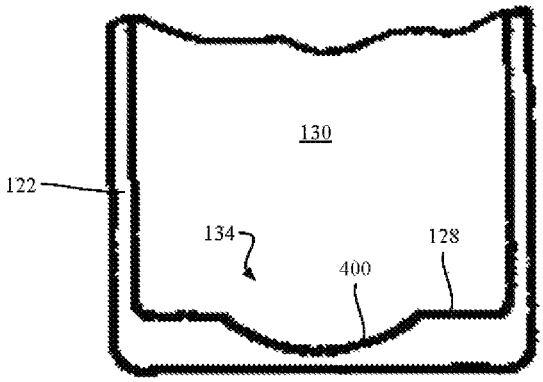
FIG. 10 illustrates a cross-sectional view of an example lens positioning guide in accordance with the present disclosure.

FIG. 10 depicts an example of a platform portion 122 with a flat floor 128 and a recess 400 formed in the floor 128. In this example, the floor 128 of the platform portion 122 includes a thickness that forms a flat bottom of the platform portion 122, and the recess 400 is formed in the flat bottom of the platform portion.

Figure 11:
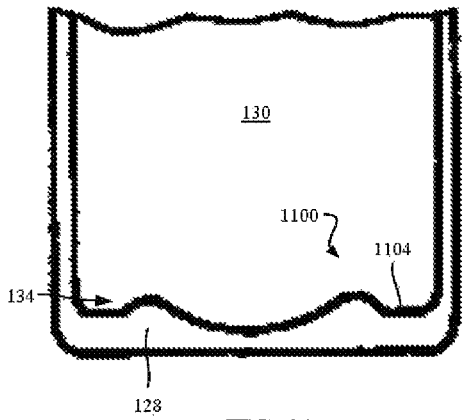
FIG. 11 illustrates a cross-sectional view of an example lens positioning guide in accordance with the present disclosure.

FIG. 11 depicts an example of lens positioning guide 134 that includes a riser 1100. The riser 1100 can be a portion that is located above the floor level 1104 of the chamber 130 that is configured to make contact with a peripheral portion 312 of the contact lens. A top portion of the riser 1100 can be spaced a distance above the floor 128, and the lens positioning guide 134 can form a concave curve that connects the riser portion. In this example, the top portion of the riser 1100 is rounded, but in other examples, the top portion of the riser 1100 can be flat, pointed, stepped, asymmetric, otherwise shaped, or combinations thereof. In the illustrated example, the center of the concave curve is located below of the floor level 1104 of the chamber 130.

Figure 12:
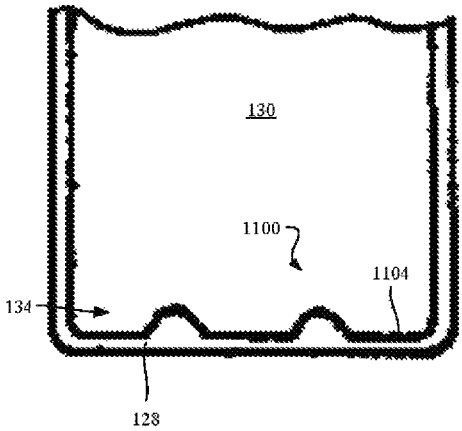
FIG. 12 illustrates a cross-sectional view of an example lens positioning guide in accordance with the present disclosure.

FIG. 12 depicts an example of a lens positioning guide 134 with risers 1100. In this example, the risers 1100 are formed in the floor 128, which rise above the floor level 1104. In this example, the chamber floor 128 is flat and the risers 1100 protrude up out of the flat floor 128 without forming a gradual curve. The risers 1100 can connect to the floor 128 without creating a continuous curve that connects the riser portions. In this example, a gap can be defined between the lens positioning guide 134 and the anterior side of the contact lens when the contact lens is located in the chamber 130.

While the depicted examples of lens positioning guides with risers include risers with sloped sides, the risers can have any appropriate shape. For example, the risers can include a sloped side, a flat side, a stepped side, another type of side of combinations thereof. Further, the risers can include a generally triangular cross section, a generally circular cross section, a generally ovoid cross section, a generally square cross section, a generally rectangular cross section, a generally symmetric cross section an symmetric cross section, another type of cross section, or combinations thereof.

In some cases, the cross sections of the risers 1100 depicted in the example of FIG. 11 are part of a continuous annular riser. In other examples, the depicted cross-sectional risers 1100 are part of isolated risers that are not connected to each other, but are spaced to center the contact lens within the chamber 130.

Unless otherwise indicated, all numbers or expressions, such as those expressing dimensions, physical characteristics, etc., used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

In addition, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

The invention claimed is:

1. A contact lens case, comprising:

a cap portion, the cap portion including:

a cap body;

a protrusion extending from the cap body;

a distal end of the protrusion;

a curved surface formed on the distal end of the protrusion;

a circumferential lip formed on the curved surface of the protrusion; and a platform portion configured to be removably secured with the cap portion, the platform portion including:

a receiving body;

an inner wall formed in the receiving body;

a floor connected to the inner wall and having a lens positioning guide; and the inner wall and the floor defining a chamber;

wherein the lens positioning guide has a recess configured to center a contact lens with regard to the curved surface of the protrusion within the receiving body, the depth of the recess being smaller than the height of the contact lens such that an edge of the contact lens disposed in the recess is separated a distance away from the floor;

wherein when the cap body is secured with the platform portion, the recess is away from the curved surface, and the recess and the curved surface are configured to collectively impose a compressive load on the contact lens such that the contact lens adheres to the curved surface.

2. The contact lens case of claim 1, wherein the lens positioning guide comprises a riser-including a top surface spaced a distance away from a surface of the floor.

3. The contact lens case of claim 1, wherein the lens positioning guide comprises a sloped surface of the floor.

4. The contact lens case of claim 1, wherein the lens positioning guide is configured to contact a peripheral portion of a contact lens disposed on the curved surface of the protrusion of the cap body when the cap portion and the platform portion are assembled.

5. The contact lens case of claim 1, wherein the lens positioning guide includes a guide curvature that substantially follows an anterior side curvature of a contact lens.

6. The contact lens case of claim 1, wherein the lens positioning guide is configured to contact a peripheral portion of a contact lens;

wherein the peripheral portion of the contact lens is disposed between a midpoint of a radius of an anterior side of the contact lens and an edge of the contact lens.

7. The contact lens case of claim 1, further comprising:

a first thread portion formed on the platform portion; and a second thread portion formed on the cap portion;

wherein the first thread portion and the second thread portion are configured to be threadedly connected to one another to close off the chamber.

8. The contact lens case of claim 7, wherein the distal end of the protrusion extends from the cap body beyond an end of the second thread portion.

9. The contact lens case of claim 7, wherein the distal end of the protrusion and the floor of the chamber are separated by less than 10 millimeters when the first thread portion and the second thread portion are threadedly connected to one another.

10. The contact lens case of claim 1, wherein the diameter of the recess is smaller than that of the circumferential lip.

11. The contact lens case of claim 1, wherein the circumferential lip comprises a lip wall extending perpendicular to the cap body toward the floor.

12. A contact lens case, comprising:

a cap portion, the cap portion including:

a cap body;

a protrusion extending from the cap body;

a distal end of the protrusion;

a curved surface formed on the distal end of the protrusion;

a circumferential lip formed on the curved surface of the protrusion; and a platform portion configured to be removably secured with the cap portion, the platform portion including:

a receiving body;

an inner wall formed in the receiving body;

a floor connected to the inner wall and having a lens positioning guide; and the inner wall and the floor defining a chamber;

wherein the lens positioning guide has a recess configured to center a contact lens with regard to the curved surface of the protrusion within the receiving body, the depth of the recess being smaller than the height of the contact lens such that an edge of the contact lens disposed in the recess is separated a distance away from the floor;

wherein when the cap body is secured with the platform portion, the recess is away from the curved surface, and the recess is configured to keep the contact lens adjacent to the curved surface of the protrusion such that the contact lens adheres to the curved surface.

13. The contact lens case of claim 12, wherein the lens positioning guide comprises a riser, the riser including a top surface spaced a distance away from a level of the floor.

14. The contact lens case of claim 12, wherein the lens positioning guide comprises a sloped surface of the floor.

15. The contact lens case of claim 12, wherein the lens positioning guide is configured to center a contact lens within the receiving body.

16. The contact lens case of claim 12, wherein the lens positioning guide is configured to contact a peripheral portion of a contact lens.

17. The contact lens case of claim 12, wherein the lens positioning guide comprises a guide curvature configured to substantially follow an anterior side curvature of a contact lens.

18. The contact lens case of claim 12, wherein the diameter of the recess is smaller than the diameter of the circumferential lip.

19. The contact lens case of claim 12, wherein the circumferential lip comprises a lip wall extending perpendicular to the cap body from the curved surface toward the floor.

* * * * *